US005263424A

United States Patent [19]

Kelly et al.

[11] Patent Number: 5,263,424

[45] Date of Patent: Nov. 23, 1993

[54] UTILITY/ACTIVITY STRUCTURE AND ACTIVITY BOARD THEREFOR

[75] Inventors: Ray G. Kelly, Kirkwood; Sharon A. Turnbough, Ellisville, both of Mo.

[73] Assignee: Angeles Group, Inc., Pacific, Mo.

[21] Appl. No.: 780,624

[22] Filed: Oct. 23, 1991

Related U.S. Application Data

[63] Continuation-in-part of Ser. No. 651,508, Feb. 6, 1991, and a continuation-in-part of Ser. No. 635,338, Dec. 28, 1990.

[51] Int. Cl.[5] ..... A47B 7/00

[52] U.S. Cl. ..... 108/91; 5/3; 5/8; 108/49

[58] Field of Search ..... 108/91, 49, 50; 5/3, 5/8, 9.1

[56] References Cited

U.S. PATENT DOCUMENTS 3,289,614 12/1966 Frazier ..... 108/91

5,003,649 4/1991 Kelly ..... 5/8

*Primary Examiner*—Kenneth J. Dorner

*Assistant Examiner*—Gerald Anderson

*Attorney, Agent, or Firm*—Paul M. Denk

[57] ABSTRACT

An activity table is made from a plurality of stackable cots and a top surface which is placed on the uppermost cot. The activity table may clamp onto particular components of the formed cots. The top surface applies as a cover on to the top of the stacked cots, and this surface may also include walls to define a basin which may hold water, toys, or even an infant. The top surface of the cots may also include other indicia, such as to form a game board, or the like. The activity boards are removably connected to the sides of the table by means of clips or brackets which engage frame members on the cots. Additionally, the activity boards are constructed to clamp onto other supporting structures, such as a table, cart, rails or balusters of a staircase.

7 Claims, 6 Drawing Sheets

UTILITY/ACTIVITY STRUCTURE AND ACTIVITY BOARD THEREFOR

CROSS-REFERENCE TO RELATED APPLICATIONS

This application is a continuation-in-part of the design applications having U.S. Ser. No. 651,508, filed on Feb. 6, 1991 still pending, and U.S. Ser. No. 635,338, filed on Dec. 28, 1990 allowed but no patent number assigned.

BACKGROUND OF THE INVENTION

This invention relates to utility tables for use in nurseries and, in particular, to a utility table formed of stackable cots and to which activity boards may be attached.

A nursery requires cots on which children can nap. When the children are not resting, nurseries require play areas and stations at which children learn to count, read, tell time, etc, or at which they play. These activity stations are often comprised of boards, easels, etc. which are often propped up against walls or placed on chairs. Furthermore, because day care centers and nurseries oftentimes have heavy enrollment, space can be at a premium.

To provide for the play area or the stations, the cots are often put to one side or stacked up so that they will be out of the way. Often the cots only take up space which could be put to better use.

SUMMARY OF THE INVENTION

One object of this invention is to provide an activity board which may be supported by a plurality of stacked cots.

Another object is to provide cots which may be stacked to define a table or stand.

Another object is to provide a surface which may be used on the floor or placed on top of the stacked cots.

These and other objects will become more apparent to those skilled in the art in light of the foregoing description and accompanying drawings.

In accordance with the invention, generally stated, there is provided a utility/activity table for use in a nursery or day care center. The activity table includes two or more stacked cots made from tubular frames. An activity board, having items thereon to teach or amuse a child, is removably secured to a side of the table. A top pad, also for use for accommodating activity, and having a flat surface, fits over the uppermost cot. The top pad may include upwardly extending walls on an upper surface thereof, defining a basin for play usage or the like on said top means upper surface. Obviously, the top pad could be made to accommodate a large variety of usage, other than just to function as a cover, or a table top, but could be used to display games, such as a game board, to provide the children with a large of variety of usage and application for the top or pad of this device.

The activity board has clamps to removably connect it to the side of the table. The clamp has spaced, generally parallel spring legs which fit between frame members of an upper and a lower cot. The legs are spaced sufficiently far apart to fit snuggly between the frame members. And, rather than fitting between frame members of two cots, the clamp's legs can fit around and sandwich the frame member of a single cot.

The activity board is a planar surface. The clamps may be secured directly to the activity board, or they may be secured to a frame which removably receives interchangeable activity boards. The frame includes opposing generally parallel spaced guide members defining channels which receive the activity board. The guide members are held together in a spaced apart relationship by the clamps. Obviously, the activity board could be constructed in a variety of ways, so as to include either a board, held together by clamps, or having side edges supporting the board held together by the clamps, or have the clamps adhered directly to the back of the board, as shown in this application. These are just an example of the variety of ways in which the activity boards can be assembled for use in conjunction with the concept of this invention.

DESCRIPTION OF THE PREFERRED EMBODIMENT

Figure 18:
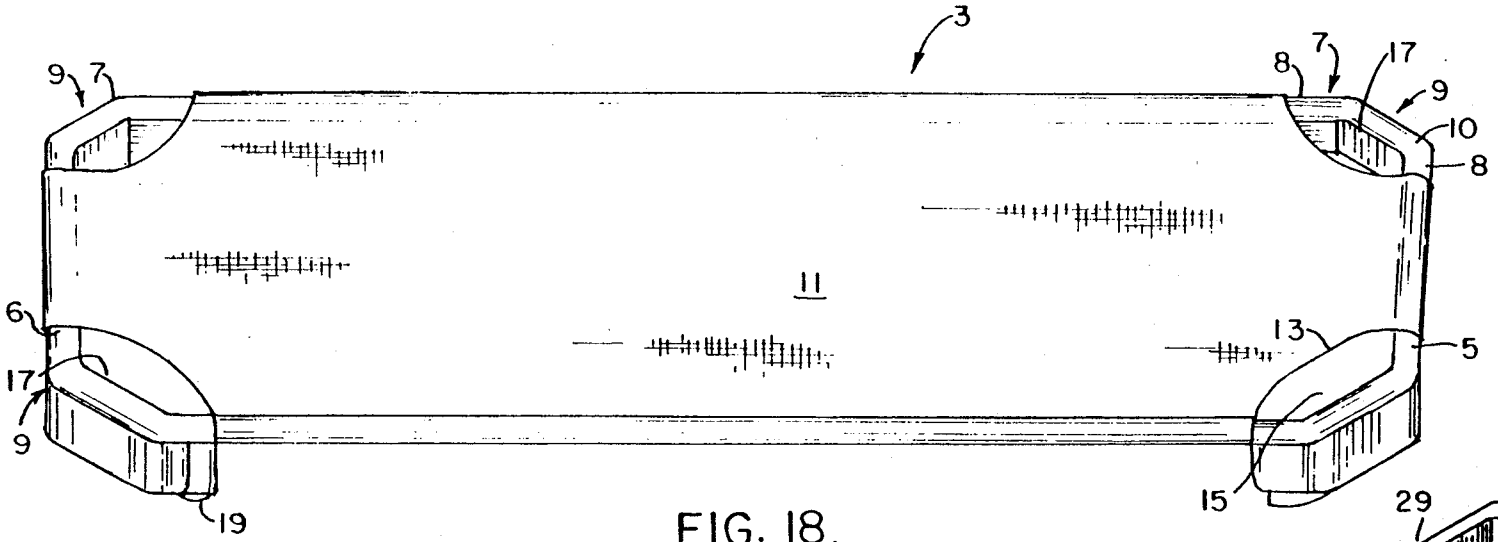
FIG. 18 is a perspective view of a stackable cot used to make the table, and support the pad.

Referring to the Figures, reference numeral 1 generally refers to an activity table of the present invention. Table 1 is made from a plurality of stacked cots 3, one of which is clearly shown in FIG. 18. The structure for such a nestable cot is disclosed in my U.S. Pat. No. 5,003,647, and its disclosure is incorporated herein by reference. Cots 3 have a frame 5 made from tubular members 6 which are joined together by couplers 7 at their corners. The tubular members are received in tube receiving portions 8 of the couplers which are joined by diagonal portions 10. Coupler portions 10 define beveled corners 9 of the cot. A web 11 of fabric extends between the frame members to provide a sleeping surface for children. Web 11 does not extend to corners 9, but rather has a cutout section 13. When the web is placed on frame 5, these cutouts define spaces 15 between web 11 and coupler 9.

Couplers 9 have integral legs 17 which extend downwardly from an inner side of the couplers and inwardly angled portions 19 at the bottom of legs 17. When the cots are stacked, legs 17 of a cot are received in spaces 15 of a cot below it and the inwardly angled portion 19 of legs 17 of the upper cot sit on the portions 19 of the lower cot. The table is formed by stacking a plurality of cots 3 in this manner. It will be apparent that the height of table 1 can be altered by changing the number of cots which are stacked.

Figure 1:
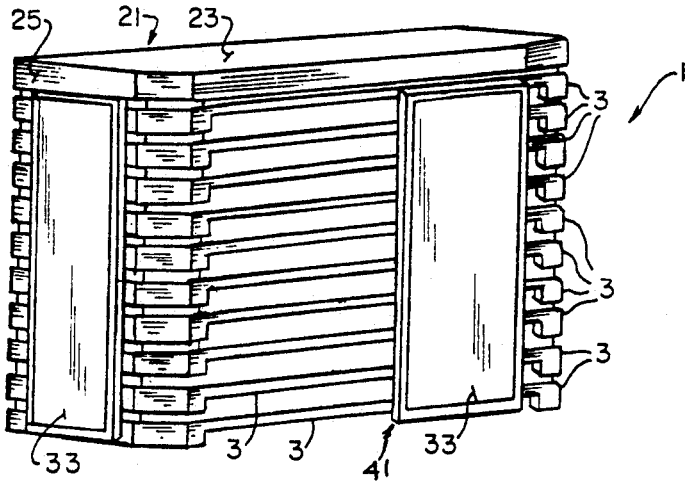
FIG. 1 is an isometric view of an activity table made from a plurality of stackable cots with a utility pad placed on top and activity boards removably attached to its sides.
Figure 2:
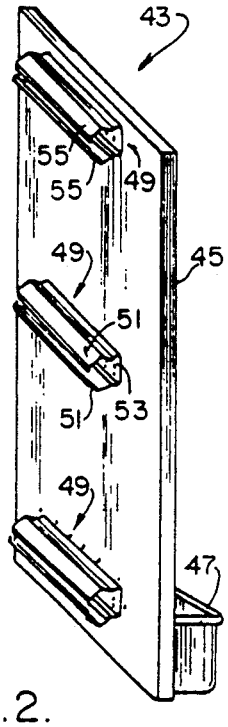
FIG. 2 is an isometric view of an activity board.
Figure 3:
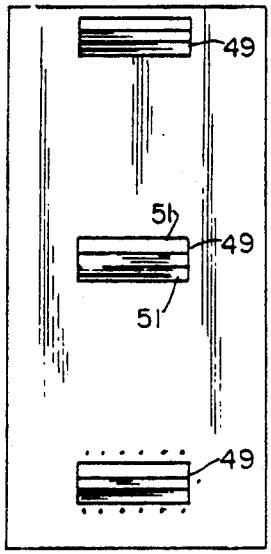
FIG. 3 is a rear elevational view of the activity board.
Figure 4:
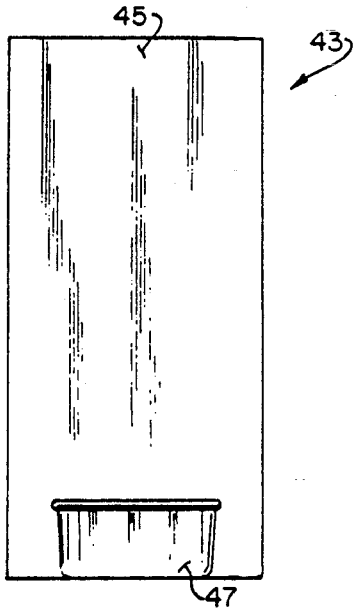
FIG. 4 is a front elevational view of the activity board.
Figure 5:
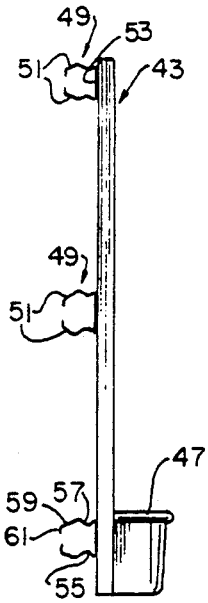
FIG. 5 is a side elevational view of the activity board.
Figure 6:
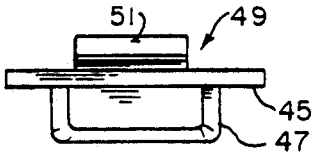
FIG. 6 is a top plan view of the activity board.
Figure 7:
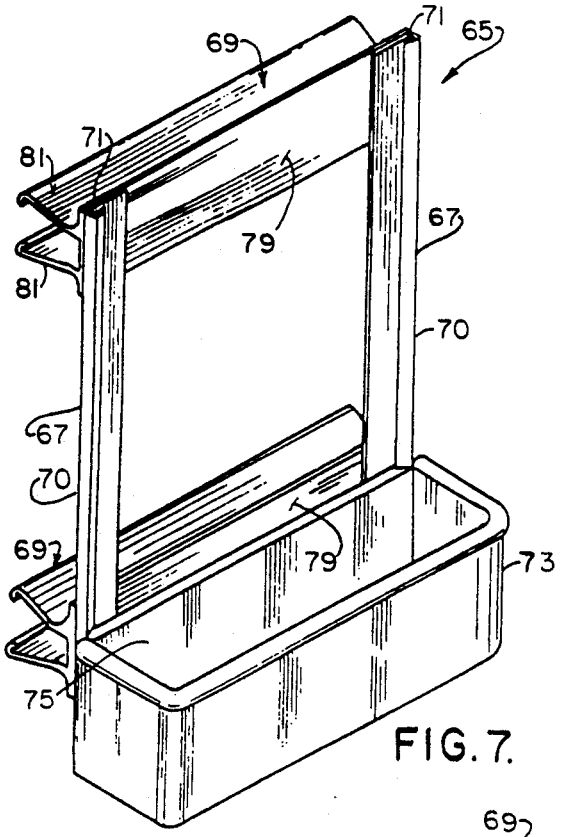
FIG. 7 is an isometric view of a frame which removably receives activity boards.
Figure 8:
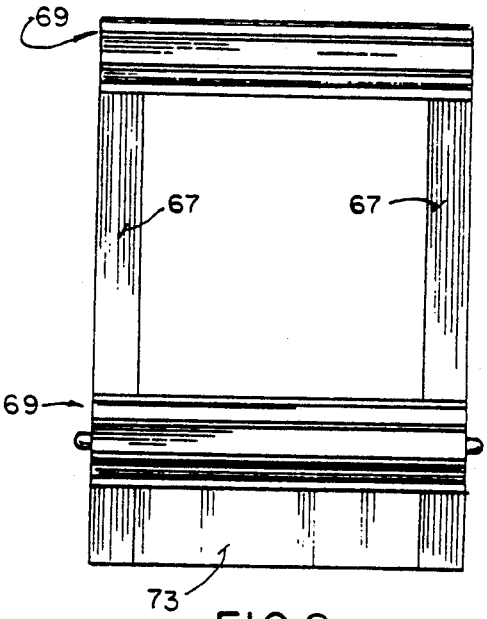
FIG. 8 is a rear elevational view of the frame.
Figure 10:
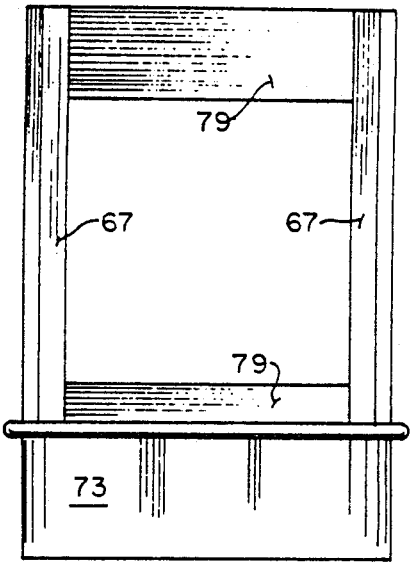
FIG. 10 is a front elevational view of the frame.
Figure 9:
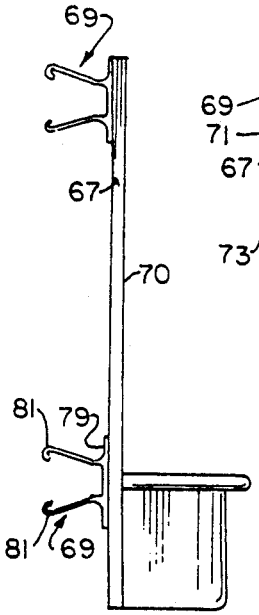
FIG. 9 is a side elevational view of the frame.
Figure 11:
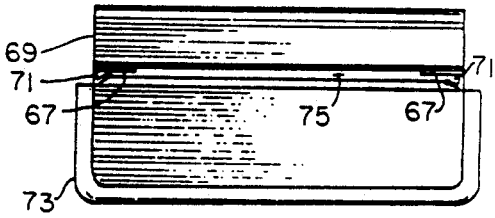
FIG. 11 is a top plan view of the frame.

Turning back to FIG. 1, table 1 has a cover or pad 21 which fits over the uppermost cot. Cover 21 has a planar surface 23 with a peripheral skirt 25. Skirt 25 fits around the uppermost cot so that cover 21 will not slide on the cot. Cover 21 is made of a material which may easily be cleaned. Thus, the children in the nursery can, for example, use the cover as a surface on which to place painting materials, or to perform other activity. If the cover gets dirty, it can thus easily be cleaned.

Figure 17:
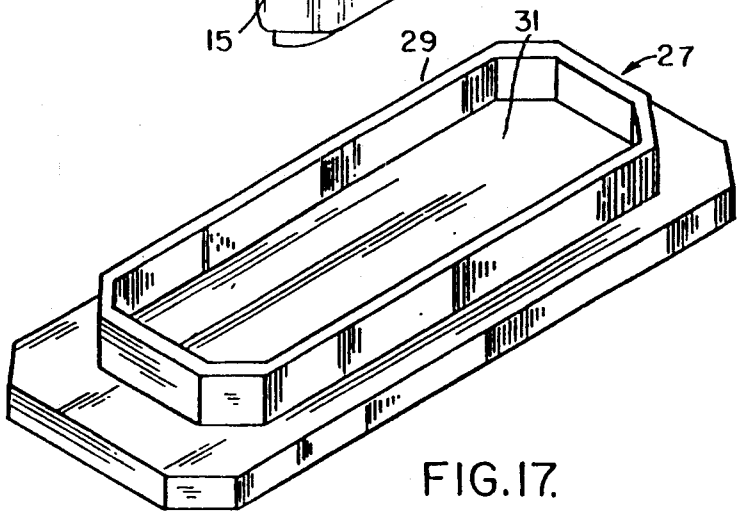
FIG. 17 is an isometric view of a second embodiment of the utility pad which covers the table.

Cover 21 may be replaced with cover 27 (FIG. 17). Cover 27 is identical to cover 21 in construction but further has upwardly extending walls 29 which define a basin 31 centered on the surface of cover 27. Basin 31 is water tight and may hold water. It is large enough to hold an infant and may thus function as a bathing station or changing table. Covers 21 and 27 may be used on the floor so that the children in the nursery have a cleanable surface on which to play. Basin 31 can be used to hold toys for children.

Again referring to FIG. 1, activity boards 41 may be removably secured to the sides of table 1. As seen in FIGS. 2–13, the activity boards may come in a variety of styles. The activity boards 41 may be drawing boards, easels or magnetic boards. They may be supplied with clocks to teach time, slidable pieces mounted on rods, like an abacus, to teach counting, strings to teach counting, etc. The activity for which the boards can be designed is limited only by the imagination of the designer.

The activity board 43, shown in FIGS. 2–6, has a back panel 45, and may have a basket 47 at its bottom which may be used to hold crayons, chalk, magnetic pieces, or items used with the activity for which the board is designed. Elongate clamps 49 are horizontally mounted to the back of panel 45. Clamps 49 preferably extend across a majority of the width of the activity board. Clamps 49 include elongate parallel resilient legs 51 which are joined by a web 53. Legs 51 are mirror images of each other. Each leg 51 includes a level part 55 extending from web 53. From level portion 55, legs 51 extend arcuately outwardly as at 57 and then inwardly as at 59 and end in an inturned vertical portion 61. Legs 51 are spaced from each other a distance equal to the distance between cot frames when the cots are stacked.

To removably secure activity board 43 to formed table 1, clamps 49 are inserted between the cot frames. Select legs 51 will deform inwardly as they are pushed between the frames and will snap back when leg portions 57 are passed between cot frames. The board 43 thus snaps into place on table 1. The length of leg portion 55 is equal to the diameter of the frame's tubular members. The activity board is thus held by leg portion 57 which holds the board 43 against the cots or the table's wall. The activity board can be removed by merely pulling the board 43 from the table. The spring legs, however, are strong enough to prevent a child from easily removing the activity board from the table.

Board 43 is shown having three clamps 49. However, it will be appreciated that only one clamp is necessary to hold it against the table. However, at least two clamps 49, an upper and a lower clamp, are desired to prevent the board from being able to swing outwardly from the table.

An activity board frame 65 is shown in FIGS. 7–12. Frame 65 includes two generally vertical parallel guides 67 which are joined in spaced apart relationship by at least two elongate clamps 69. Guides 67 have outer edges 70 which are bent at their outer edges to define channels 71 which extend approximately the length of guides 67. The bottom of channels 71 are closed. In the embodiment shown, a basket 73 has a back wall 75 the top of which closes the bottoms of channels 71.

Figure 12:
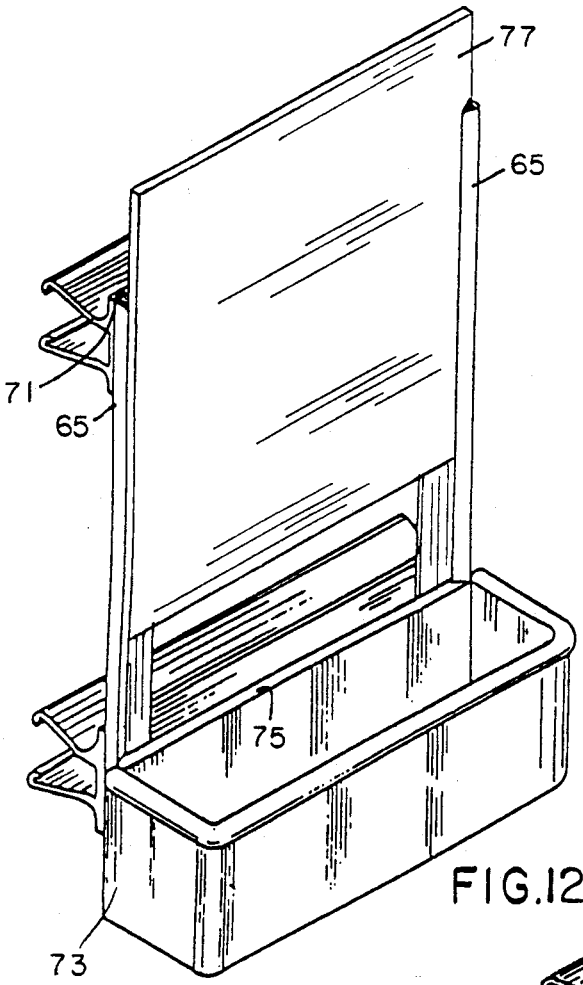
FIG. 12 is a perspective view of the frame removably receiving an activity board.

Frame 65 removably receives an activity board 77. (FIG. 12). Board 77 is slideably received in channels 71 and rests on the back wall 75 of basket 73. Wall 75 thus acts as a stop for the board. The activity boards which are removably received in frame 65 can be interchanged with each other.

Although clamp 49 can be used with frame 65, a different clamp 69 is shown. Clamp 69 includes an elongate base 79 having elongate spring legs 81 extending diagonally away from each other. The backs of bases 79 are secured to the backs of guides 67 so that legs 81 extend away from the guides. Clamp 69 works in the same manner as clamp 49 to hold frame 65 to table 1. Clamps 49 and 69 are interchangeable and either clamp may be used with a selected frame or activity board.

Figure 13:
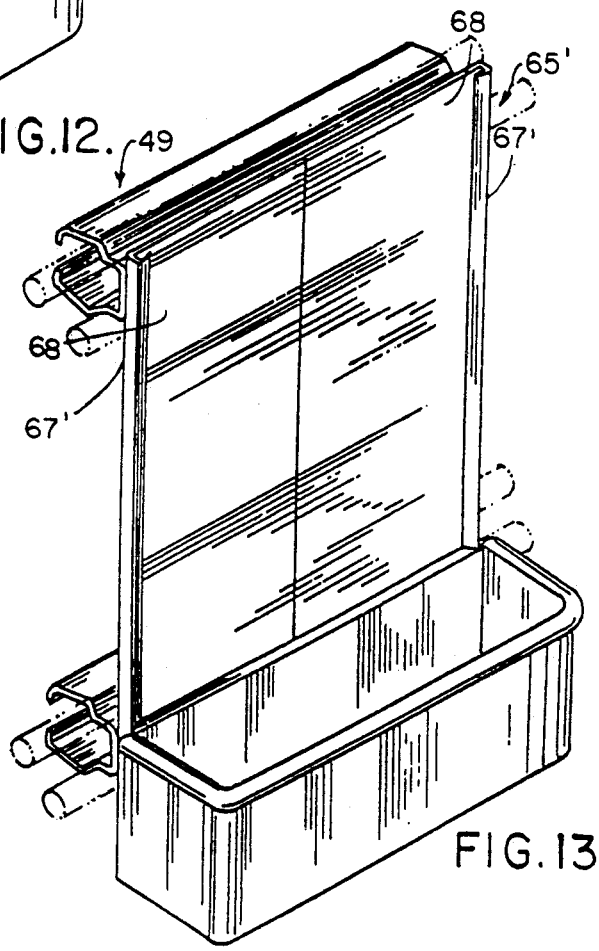
FIG. 13 is a perspective view of an alternate embodiment of the frame.

An alternative to frame 65 is shown in FIG. 13. The frame 65' of FIG. 13 has guides 67' which have back walls 68 which meet in the middle of frame 65' to give the frame a solid back. It will be noted that frame 65' as shown in FIG. 13 has clamps 49 attached thereto to secure it to table 1.

Figure 14:
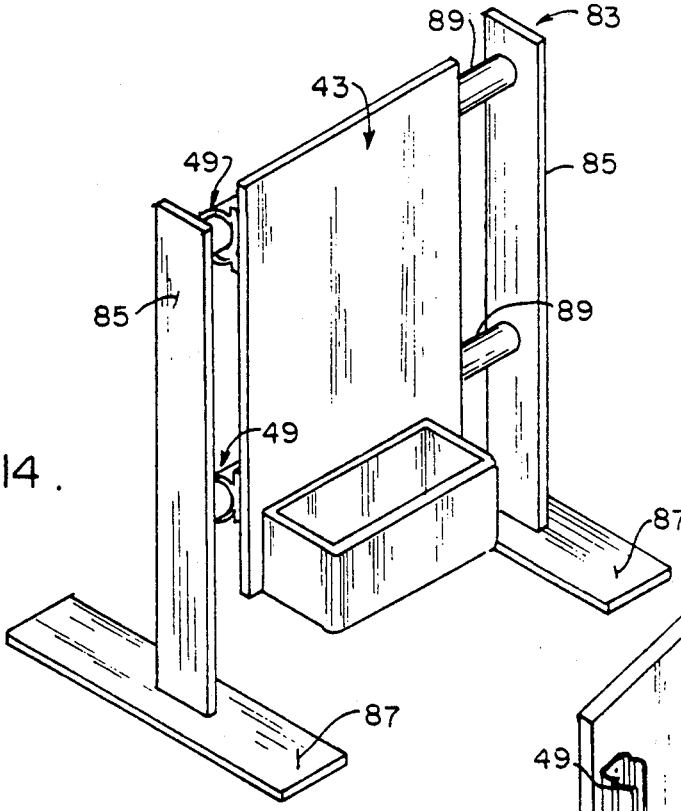
FIG. 14 is an isometric view of an activity board removably attached to a stand.

FIG. 14 shows activity board 43 removably secured to a stand 83. Stand 83 includes legs 85 having feet 87 at the bottom thereof. A pair of spaced apart round bars or tubes 89 extend between and connect legs 85. Clamp 49 engages bars 89 to hold activity board 43 to stand 83. Rather than the outsides of the legs extending between bars 89, as with table 1, legs 51 sandwich bars 89. When forced onto the bars, the legs 51 are forced apart until vertical portions 61 clear the bar 89. The legs then snap together to hold the activity board to stand 83. Feet 87 extend in front of and in back of legs 85 sufficiently far to give the stand appropriate stability while it is being used by children.

Figure 15:
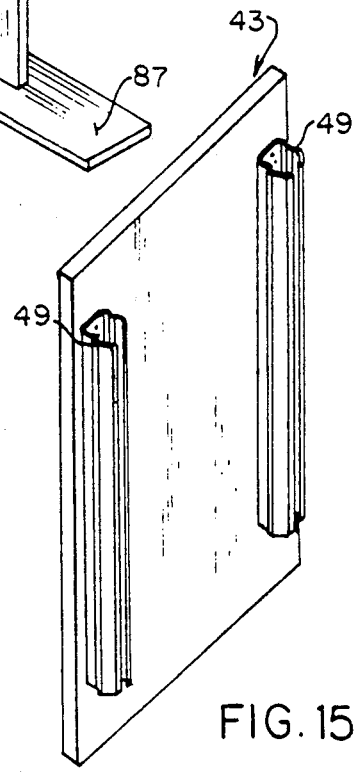
FIG. 15 is a perspective view of an activity board showing clips mounted vertically rather than horizontally thereon.
Figure 16:
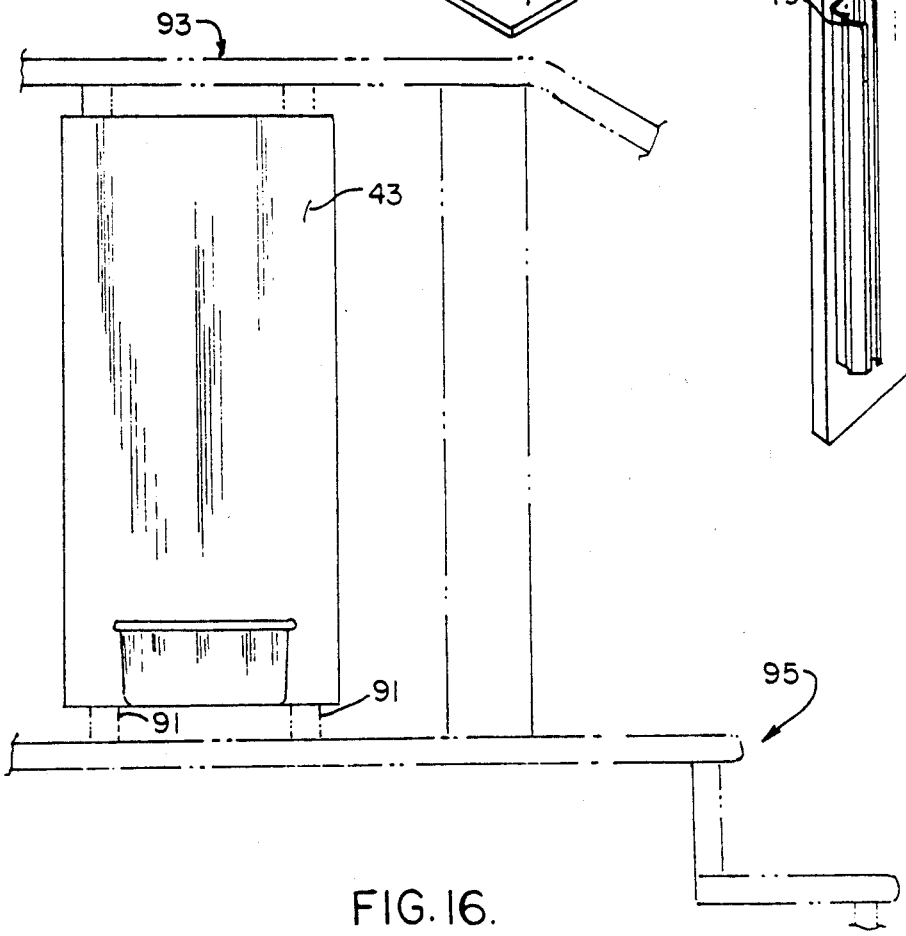
FIG. 16 is a front elevational view of the activity board of FIG. 15 removably mounted to balusters of a stair rail.

In FIG. 15, clamps 49 are vertically secured to the back of activity board 43. This allows the board to be secured to vertical bars, such as balusters 91 of a handrail 93 of a staircase 95, as shown in FIG. 16. The clamps 49 are used here, in the same manner as with the stand 83.

Figure 19:
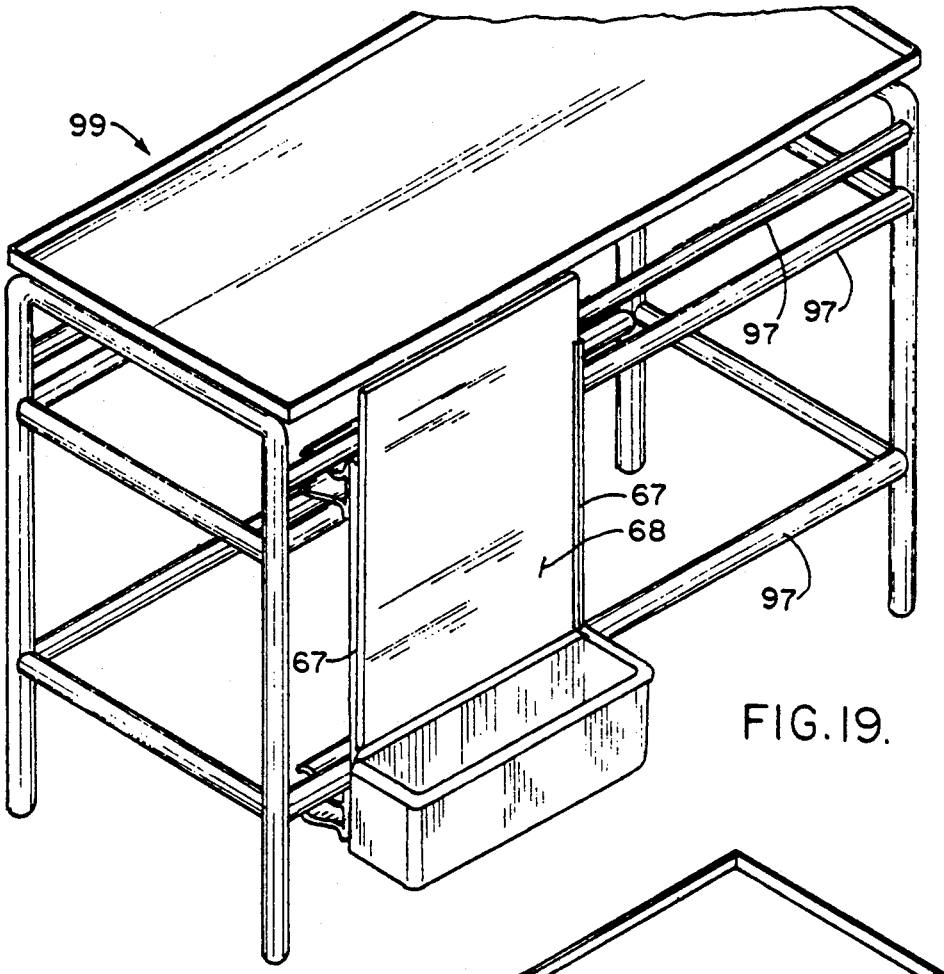
FIG. 19 shows an isometric view of an activity board clamping onto the side of a utility table.
Figure 20:
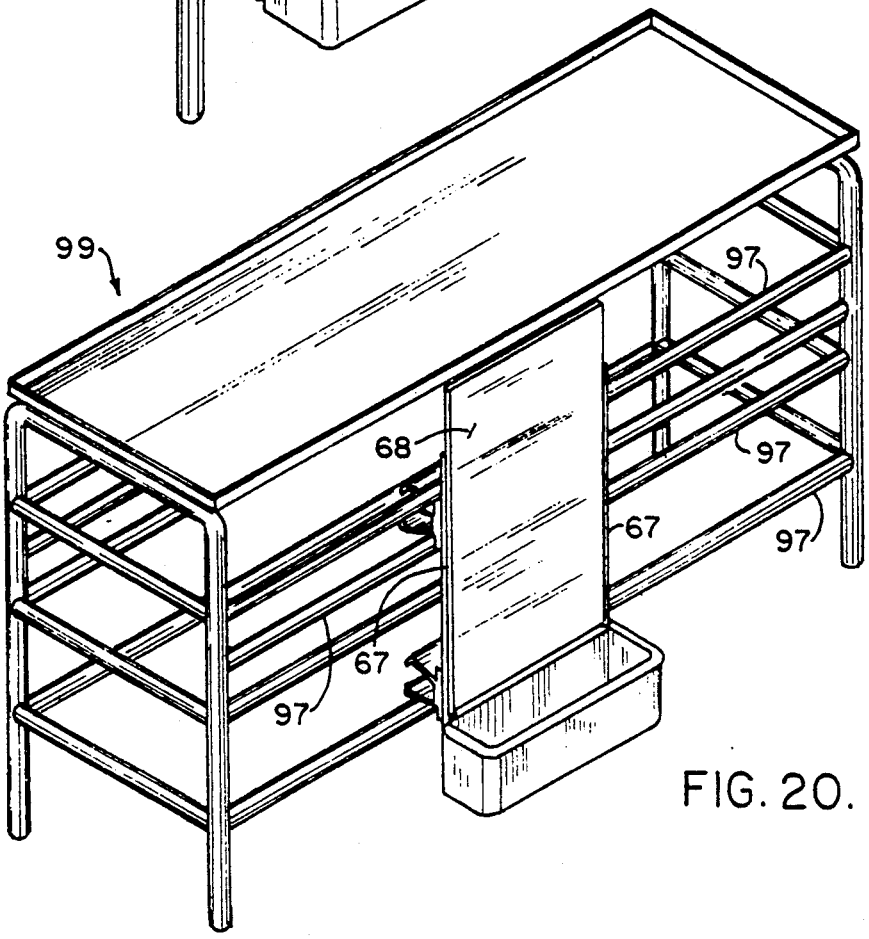
FIG. 20 shows an activity board, of one style of the infinite variety of styles shown in this application, clamping onto an elongated utility table.

FIGS. 19 and 20 disclose an activity board, of any one of the style as described in this application, but more particularly that which is shown in FIG. 13, which incorporates a pair of guides 67 holding the activity board 68, as noted. In this particular instance, the activity boards are clamped onto the side rails, such as the rails 97, as shown, for a utility table or cart, as shown at 99. These are just examples as to how the activity board of this invention can have widespread usage and application in conjunction with a variety of supporting structures, such as the cots, the stand, stair railings, tables, carts, and the like, as explained in this application.

Numerous variations, within the scope of the appended claims, will be apparent to those skilled in the art in light of the foregoing description and accompanying drawings. For example, the guides of frame 65 could be horizontally positioned rather than vertically positioned. The clamp which is used to secure the activity board to the cot frames or the stand could merely have two spaced spring legs, one spring leg which engages an upper frame member or bar adjacent and beneath that upper bar and a second spring leg which engages a lower frame member or bar adjacent and above that bar. These examples are merely illustrative.

Having thus described the invention, what is claimed and desired to be secured by Letters Patent is:

1. A utility/activity structure for use in a nursery comprising two or more stacked cots, each said cot including a frame, having front, back and side members, a web extending between said members defining a surface on which a child may lay, and means for stacking said cots, said cots including connectors defining corners therefor and providing the means for stacking of said cots, an activity board means removably secured to said structure, said frame members being joined by said connectors defining corners for said cots, there being four such corners on each cot, said web including cutouts at the corners thereof to define a web-free space between said web and said corners, and the stacking means comprising leg means at said cot corners, said leg means being formed and positioned so that the leg means of an upper cot fits in said web-free area of a lower cot adjacent the corner of said lower cot, and top means stackable on the uppermost cot, said top means having a flat surface.

2. The table of claim 1 wherein said activity board means includes activity means thereon for teaching or amusing a child and means for removably connecting said activity board to a vertical portion of said table.

3. The structure of claim 2 wherein said connecting means includes at least one clamp having first and second spaced, generally parallel spring legs which sandwich a frame member of one of said cots.

4. The structure of claim 2 wherein said activity board means includes a planar surface defining an activity board to which said connecting means is secured.

5. The structure of claim 4 wherein said activity board means further includes means for holding items.

6. A utility/activity structure for use in a nursery comprising two or more stacked cots, each said cot including a frame, having front, back and side members, a web extending between said members defining a surface on which a child may lay, and means for stacking said cots, each cot having connectors defining corners and said connectors providing the means for stacking of said cots, and an activity board means removably secured to said structure, said activity board means includes activity means thereon for teaching or amusing a child, said means comprising a planer surface, and means for removably connecting said activity board to a vertical portion of the stacked cots structure, said means for removably connecting comprising clamps, said connecting means includes at least one clamp having spaced, generally parallel spring legs, said legs cooperating with the frame members of an upper and lower cot, said legs being spaced sufficiently far apart to snugly adhere to said frame members.

7. The structure of claim 6 wherein said connecting means includes at least one clamp having spaced, generally parallel spring legs, said legs fitting between frame members of an upper and a lower cot, and said legs being spaced sufficiently far apart to fit snugly between said members.

* * * * *

UNITED STATES PATENT AND TRADEMARK OFFICE

CERTIFICATE OF CORRECTION

PATENT NO. : 5,263,424

DATED : November 23, 1993

INVENTOR(S) : Ray G. Kelly, and Sharon A. Turnbough.

It is certified that error appears in the above—identified patent and that said Letters Patent is hereby corrected as shown below:

Claim 3, column 6, line 5, change "2" to ---6---.

Claim 4, column 6, line 9, change "2" to ---6---.

Signed and Sealed this

Fourteenth Day of June, 1994

Bruce Lehman

*Attest:*

BRUCE LEHMAN

*Attesting Officer*

*Commissioner of Patents and Trademarks*